US005315309A

United States Patent [19]

Rudow et al.

[11] Patent Number: 5,315,309

[45] Date of Patent: May 24, 1994

[54] DUAL POLARIZATION ANTENNA

[75] Inventors: Richard W. Rudow; Kenneth A. Wroblewski, both of Mesa, Ariz.

[73] Assignee: McDonnell Douglas Helicopter Company, Mesa, Ariz.

[21] Appl. No.: 756,075

[22] Filed: Sep. 6, 1991

[51] Int. Cl.[5] ..... H01Q 1/28

[52] U.S. Cl. ..... 343/705; 343/708; 343/828

[58] Field of Search ..... 343/705, 708, 725, 727, 343/803, 806, 828

[56] References Cited

U.S. PATENT DOCUMENTS

| | | | |
|---|---|---|---|
| Re. 33,276 | 7/1990 | Presholdt | 343/725 |
| 2,516,706 | 7/1950 | Laport | 343/867 |
| 2,636,987 | 4/1953 | Dorne | 343/708 |
| 2,908,904 | 10/1959 | Atta et al. | 343/725 |
| 2,980,910 | 4/1961 | Fourcade | 343/708 |
| 3,622,890 | 11/1971 | Fujimoto et al. | 343/829 |
| 3,754,264 | 8/1973 | Blackband | 243/705 |
| 3,881,154 | 4/1975 | Lewis et al. | 325/67 |
| 4,015,263 | 3/1977 | Koerner et al. | 343/708 |
| 4,197,547 | 4/1980 | Czerwinski | 343/708 |
| 4,217,591 | 8/1980 | Czerwinski | 343/713 |
| 4,325,141 | 4/1982 | Ghose | 455/63 |
| 4,510,500 | 4/1985 | Brune | 343/708 |
| 4,635,066 | 1/1987 | St. Clair et al. | 343/828 |
| 4,670,760 | 6/1987 | Biby | 343/832 |
| 4,731,615 | 3/1988 | Presholdt et al. | 343/725 |
| 4,739,336 | 4/1988 | Campbell et al. | 343/806 |
| 4,962,488 | 10/1990 | Dell-Imagine et al. | 343/709 |

FOREIGN PATENT DOCUMENTS

| | | | |
|---|---|---|---|
| 2406487 | 8/1975 | Fed. Rep. of Germany | 343/803 |
| 2521309 | 11/1975 | Fed. Rep. of Germany . | |
| 2113922 | 8/1983 | United Kingdom | 343/705 |

*Primary Examiner*—Donald Hajec
*Assistant Examiner*—Tan Ho
*Attorney, Agent, or Firm*—Donald E. Stout; John P. Scholl

[57] ABSTRACT

A dual polarization antenna for use on an aircraft, preferably a helicopter or the like, permits practical and reliable high frequency radio communications in a severe non line of sight, nap of the earth flight environment. The antenna comprises both a horizontally polarized component and a vertically polarized component. The horizontally and vertically polarized components are formed of an integral element, which has a bend therein so that the two components have an angular orientation with respect to one another. The horizontally polarized component is oriented in a generally horizontal direction and the vertically polarized component is oriented in a generally vertical direction. Ideally, the horizontally and vertically polarized components are oriented as orthogonally to one another as possible, depending upon the airframe application.

12 Claims, 2 Drawing Sheets

DUAL POLARIZATION ANTENNA

BACKGROUND OF THE INVENTION

This invention relates to antennas, and more particularly to a dual polarization antenna specifically adapted to provide better communications in a helicopter environment.

High frequency (HF) radio systems (radios that operate between 2 and 30 mhz) have been used on helicopters and fixed wing aircraft for many years. The non-line-of-sight (NLOS) capabilities of the HF band are well known. It is also known that some HF propagation modes are extremely frequency dependant, requiring that the radio operator have an intuitive knowledge of the usable frequencies for a particular time of day. Often the radio operator must place calls on several frequencies before clear communication can be established. At times, communications may not be possible. This level of operator control renders the traditional HF radio system unusable in the combat helicopter environment. Most combat helicopters are therefore currently equipped with line-of-sight (LOS) radios only. However, many missions require them to employ nap of the earth (NOE) flight profiles in which current radio systems are not effective.

High frequency automatic link establishment (ALE) radio systems, such as the HF-9000 radio system manufactured by Rockwell/Collins, Inc., automate the operation of the traditional HF radio system, and render possible the employment of HF radio systems in combat helicopters. In such a system, the pilot establishes communication by placing a call to the desired party. This is easily accomplished by selecting the address of the party to call and keying the microphone. Operator knowledge of the proper frequency to use is not necessary for radio operation. The radio system chooses the best frequency for communication and automatically establishes a link with the desired contact. The pilot is notified when the link is established and can at that point communicate as with any other radio system. It is this automated capability that makes an HF radio system a practical solution for combat helicopters flying NOE NLOS flight profiles. The optimum frequency selection is based on the analysis of prior transmissions from the desired contact. If the database of prior transmissions is unavailable, the system automatically attempts communications on all available frequencies until communications success is achieved.

The theory behind HF propagation has been well understood for many years. In general, there are four primary propagation paths supported by the HF band that can allow NLOS NOE communications. The most commonly used propagation path in the HF band is skywave. Skywave propagation, by using ionospheric reflections or ionospheric scattering, can allow communications ranges exceeding several thousand miles. Near Vertical Incident Skywave (NVIS) is essentially high critical angle skywave propagation and can support communications to 300 km. Lastly, the ground wave propagation surface wave component can support communications to 40 or 50 km and the line-of-sight component can support communications to several hundred km depending on aircraft height. FIG. 1 illustrates the various HF propagation paths. Each of these primary propagation paths have variables involved that can drastically affect communications range and include multiple secondary propagation effects that at times are useful for communications.

The past approach employed in severe non-line-of-sight environments was to rely on NVIS propagation to reflect electromagnetic waves off of the ionosphere. The antennas used for this function were generally horizontal in nature in that they were mounted on helicopters along the tail boom. This horizontal orientation was necessary to couple the energy reflected off of the ionosphere into the antenna. The problem with NVIS propagation is reliability. The reliability is a function of the ionospheric electron density which in turn is a function of the amount of solar radiation from the sun. As a result, the NVIS communications reliability is often poor at night when the sun has set.

What is needed, therefore, is an antenna system which complements NVIS propagation with ground wave propagation to increase the communications reliability in an aircraft severe non-line-of-sight environment.

SUMMARY OF THE INVENTION

This invention solves the problem outlined above by providing a single passive dual polarization antenna for transmitting and receiving high frequency radio signals, which permits transmission/reception of the surface wave component of ground wave propagation, the LDS component of ground wave propogation, skywave propogation and Near Vertical Incident Skywave propagation. The result is much more reliable HF communications.

The inventive antenna includes both a horizontally polarized component and a vertically polarized component. The horizontally and vertically polarized components are formed of an integral highly conductive element, which has a bend therein so that the horizontally and vertically polarized components have an angular orientation with respect to one another. The horizontally polarized component is oriented in a generally horizontal direction and the vertically polarized component is oriented in a generally vertical direction. Ideally, the horizontally and vertically polarized components are oriented as orthogonally to one another as possible, depending upon the airframe application. In one preferred embodiment, that orientation angle is approximately 60 degrees. The antenna is preferably an electric field antenna, of the open type, rather than being grounded.

In yet another aspect of the invention, the dual polarization antenna is adapted for an aircraft having a generally horizontally oriented surface and a generally vertically oriented surface. The horizontally polarized component is adapted to be mounted on the generally horizontally oriented aircraft surface, while the vertically polarized component is adapted to be mounted on the generally vertically oriented aircraft surface.

In yet another aspect of the invention, a helicopter comprises a generally horizontally oriented tailboom, a generally vertically oriented vertical stabilizer, and the inventive dual polarization antenna. The horizontally polarized antenna component is adapted to be mounted on the tailboom and the vertically polarized component is adapted to be mounted on the vertical stabilizer.

The above mentioned and other objects and features of this invention and the manner of attaining them will become apparent, and the invention itself will be best understood, by reference to the following description taken in conjunction with the accompanying illustrative drawings.

DETAILED DESCRIPTION OF THE INVENTION

The present invention adopts the concept of complementing NVIS propagation with ground wave propagation to increase the communications reliability. Ground wave propagation requires a vertical antenna to effectively receive information. The ground wave signal strength rolls off rapidly with increased range due to losses attributed to the Earth's poor conductivity. Research performed in the development of this invention demonstrated ground wave as a reliable NLOS propagation mode out to as far as about 60 kilometers over desert terrain such as that found in the state of Arizona, with very strong communications out to about 40 kilometers. On the other hand, information received by NVIS propagation is usually weak due to high ionospheric absorption and a loss of significant energy into outer space. However, the NVIS range of operations can extend past several hundred kilometers. The subject antenna was developed to receive both NVIS and ground wave information to take advantage of the desirable features of both modes.

Figure 2:
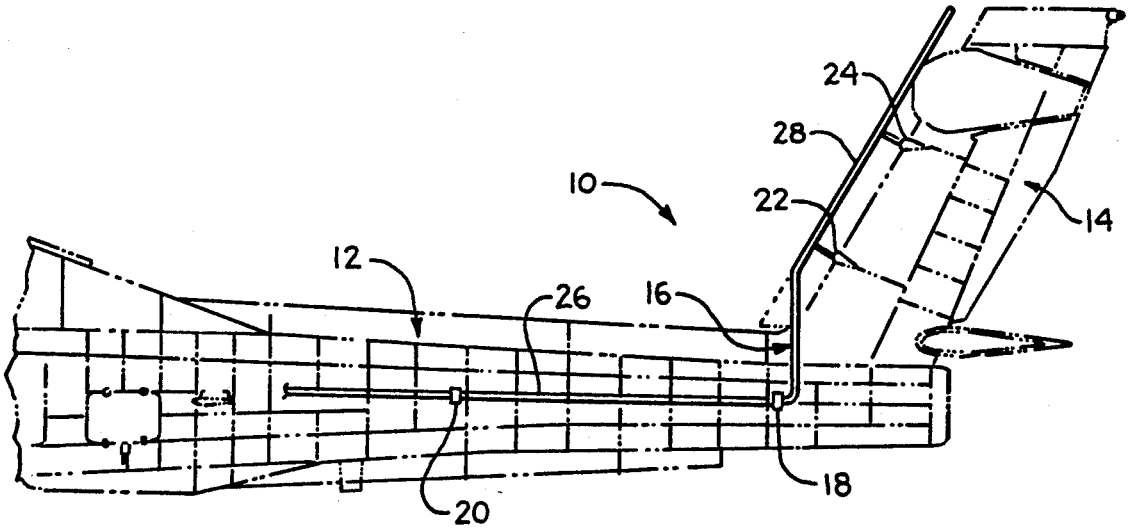
FIG. 2 is an elevational view of the tail boom and vertical stabilizer of a helicopter, showing an installation application of the inventive dual polarization antenna.

Referring now to FIG. 2, a tail section of a helicopter 10 is shown, including the tail boom 12 and the vertical stabilizer 14. An antenna 16 constructed according to the invention is mounted to the tail boom 12 at attachment points 18 and 20, and is mounted to the vertical stabilizer 14 at attachment points 22 and 24. Dual polarization antenna 16 is comprised of a long horizontally polarized component 26, which is mounted to the tail boom 12, and a long vertically polarized component 28, which is mounted to the vertical stabilizer 14. In the preferred embodiment, the antenna 16 is generally L-shaped, being formed of a single integral conductive element having a bend therein, such that the horizontally and vertically polarized components 26 and 28, respectively, have an angular orientation with respect to one another. The horizontally polarized component 26 is oriented in a generally horizontal direction and the vertically polarized component is oriented in a generally vertical direction. Ideally, the horizontal and vertical components of the antenna 16 are arranged to be as orthogonal as the application airframe will allow. In one preferred application, the angle $\infty$ between the two antenna components is about 60 degrees. The antenna is preferably comprised of a one inch diameter aluminum tube, although of course other known antenna types could be employed as well. Any known means, such as a bracket surrounding the antenna tube 16 and being bolted to the helicopter 10 at mounting points 18, 20, 22, and 24, may be employed for mounting the antenna 16 to the helicopter 10. Of course, any number of mounting points may be employed.

There are four key advantages of the dual polarization antenna (DPA) of the subject invention over the prior art antennas. These four advantages include the ability to utilize the four key propagation modes without mode switching, all aspect transmission/reception, high efficiency, and ability to efficiently operate on partial or all composite airframes as well as typical aluminum structures. The four key propagation modes mentioned above are the surface wave component of ground wave propagation, the line-of-sight component of ground wave propagation, near vertical incident skywave (NVIS) propagation, and skywave propagation. There are four primary aircraft mission aspects that utilize these propagation modes. First, in the shorter range non-line-of-sight nap of the earth mission (less than 40 or 50 km) the DPA is designed to transmit/receive both surface wave and NVIS simultaneously. The horizontal DPA component supports NVIS propagation (high critical angle ionospheric reflections) and the vertical component supports surface wave propagation (radiation parallel to the Earth's surface using the Earth as a conductor). This augments NVIS with surface wave for overall improved reliability over antennas such as the shorted loop type with only horizontal components, as is presently the state of the art in many aircraft applications. Second, in the missions where aircraft altitudes allow line-of-sight communications, vertical polarization from the vertical antenna component is primarily used allowing omnidirectional communications with ground forces using standard whip or inverted "V" dipole antennas. Aircraft with shorted loop antennas often have pattern nulls off the nose and tail and require horizontally polarized antennas to achieve the best line-of-sight reception. Third, for communications in the 50 to 300 km range, the horizontal antenna component is primarily used to receive NVIS propagation since surface wave is no longer existent. Fourth, for long range communications in excess of 300 km, skywave propagation is utilized and both the horizontal and vertical antenna components couple energy to the receiver. The critical angle of ionospheric reflection determines how much energy is received by each component.

The key features of the DPA concept which distinguish it from prior art antenna systems are twofold. First, the DPA antenna has two distinct components, one horizontal and one vertical. The horizontal and vertical components are as orthogonal as the application airframe will allow. Second, the DPA is an electric field antenna and thus is not grounded at the end but rather is open; i.e. it is electrically insulated from the aircraft structure. Because of its unique configuration and properties, it can provide adequate all aspect transmission and reception when under maneuvers, including complete loops and rolls. In pitch maneuvers, the horizontal antenna component swings to the vertical providing typical DPA coverage even at severe pitch attitudes. In roll maneuvers, the vertical antenna component rotates to the horizontal, creating a significant increase in effective horizontal receive area, although of course vertical polarization is sacrificed. This could impact short range missions which utilize surface wave, but the orthogonal horizontal component arrangement prevents horizontal polarization nulls off the nose unlike the shorted loop, and thus omnidirectional horizontal polarization in line-of-sight modes is possible. Another consideration is all aspect transmission/reception due to the variety of arrival paths for each of the four propagation modes. As an example, for some skywave paths the DPA will receive better than a traditional slant wire due to the distinct horizontal and vertical components of the antenna.

An additional advantage of the DPA antenna of the subject invention is improved efficiency over slant wire antennas. The effective DPA length is significantly longer than a slant wire antenna that also has some dual polarization properties. The end result is more efficient tuning that results in more power being transferred to the antenna and less power loss in the radio system antenna coupler. Another primary design consideration is the ability to utilize the DPA concept on partially composite or all composite airframes. Shorted loop antennas require a conductive return path through the airframe to create a loop for magnetic field reception. The DPA concept uses the airframe as a ground plane. The conductive properties of the airframe do affect the radiation pattern and efficiency of the DPA but not to the extent seen for a shorted loop type antenna since the DPA concept uses the electric field component of the electromagnetic wave.

Figure 1:
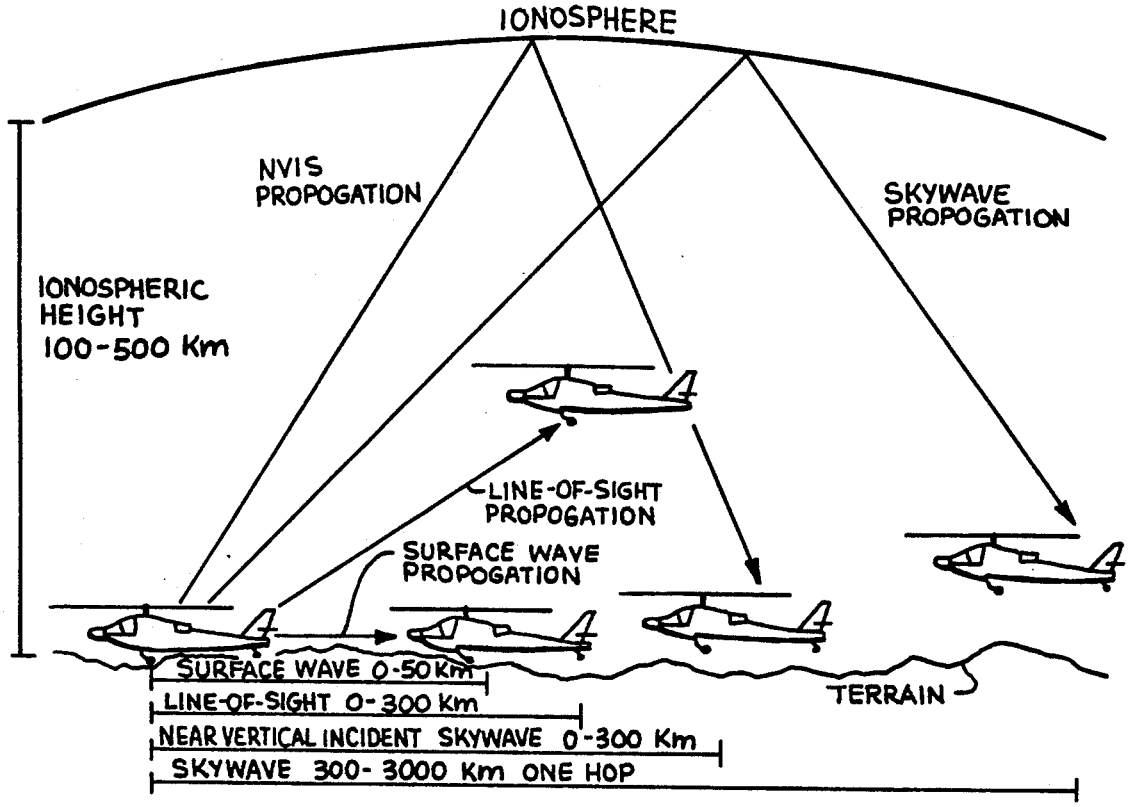
FIG. 1 is a diagrammatic representation of various HF propagation paths presented for the purpose of providing background information.
Figure 3:
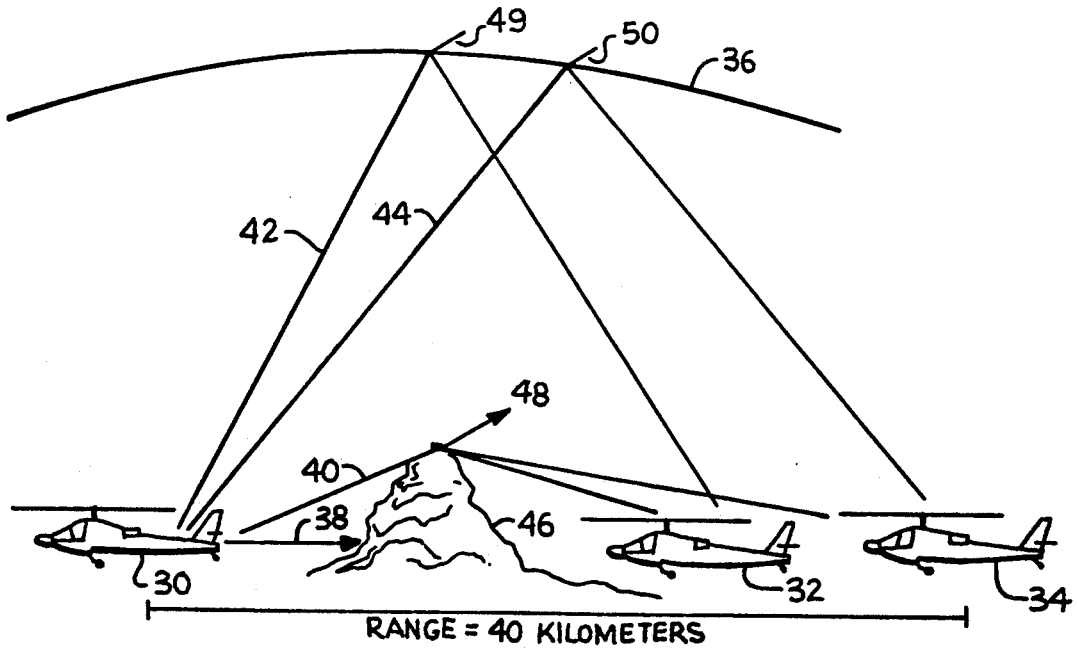
FIG. 3 is a diagrammatic representation of a typical HF radio communication, comparing the relative functions of the inventive antenna with a prior art antenna.

Referring now to FIG. 3, a diagrammatic representation is shown comparing HF communications between a DPA equipped transmitting helicopter 30 and two receiving helicopters 32 and 34. Helicopter 32 is equipped with a passive dual polarization antenna, while helicopter 34 is equipped with a state of the art shorted loop antenna, which is only horizontally polarized. The ionosphere, which has a height of approximately 300 kilometers, is shown at 36. When a signal is transmitted from the helicopter 30, surface wave components 38 and 40 are emitted from the vertical segment of the DPA, while near vertical incident skywave (NVIS) components are emitted from the horizontal segment of the DPA. As can be seen from the figure, component 38 of the surface wave transmission is absorbed by the hill 46. On the other hand, component 40 traverses the hill 46 and is beamed to each helicopter 32, 34, although a portion of the signal 48 is lost due to electromagnetic diffraction. The NVIS signals 42 and 44 bounce off of the ionosphere 36, as shown, and are available for reception by both receiving helicopters 32, 34 as well, although a portion of the signal 49, 50 is lost due to ionospheric penetration and absorbtion. The helicopter 34, being equipped only with a horizontally polarized shorted loop antenna, receives only the NVIS signal, since it has no vertical antenna component for receiving the vertically polarized surface wave signal. However, the helicopter 32, being equipped with the DPA of the subject invention, receives both the surface wave and the NVIS signals.

The FIG. 3 example, as well as numerous tests conducted in support of this invention, demonstrate the advantages of an antenna which is capable of receiving both NVIS and ground wave information in order to improve reliability of operation. At closer ranges, the primary signal that is received is the strong ground wave signal, while at longer ranges, where ground wave is no longer existent, the NVIS signal is used. Test results indicate that reliable voice communications in severe nap of the earth non-line-of-sight conditions are possible at all times of day at ranges to 40 km using ground wave propagation. Communications to 300 km are reliable during the day, but become extremely weak late at night. This range is achieved with primarily NVIS propagation. In fact, skywave propagation would allow effective communications well beyond 300 km with good day time operation and improved night time operation depending on ionospheric conditions since the ionospheric critical angle is reduced from NVIS propagation due to increased range. These tests demonstrated the need for a helicopter to have an antenna or antennas that have vertically polarized components for the clearer and more reliable shorter range ground wave propagation and horizontally polarized components for the longer range less reliable NVIS propagation. The tests further demonstrated that the most effective frequency band to support joint ground wave and NVIS propagation is between 2.0 mhz and 10 mhz. Typically, six frequencies evenly distributed throughout this band are all that are really required to support reliable communications.

Although the tests support the desirability of having both horizontal and vertical antennas on the aircraft to support all propagation modes, a single dual polarization antenna having a single radiation feedpoint, such as the antenna of the subject invention, is preferred over two separate antennas because of operational considerations. Having to switch between two different antennas for communications would require mechanical complexity and algorithm development to determine the best time to switch, or advanced airborne receivers for diversity processing.

Although an exemplary embodiment of the invention has been shown and described, many changes, modifications, and substitutions may be made by one having ordinary skill in the art without departing from the spirit and scope of the invention. For example, a conductive wire could be used for the DPA element instead of an aluminum tube. The angle between the horizontal and vertical components could be significantly less than 90 degrees or even 60 degrees and still perform reasonably well. Furthermore, although the invention is preferably employed on a helicopter, it may be employed in other types of installation applications as well, including fixed wing aircraft, ground vehicles, and stationary structures. Therefore, the scope of the invention is to be limited only in accordance with the following claims.

What is claimed is:

1. A passive dual polarization antenna for transmitting and receiving high frequency radio signals in the 2–30 MHz band comprising:

a horizontally polarized component; and a vertically polarized component, said horizontally and vertically polarized components being formed of a single integral conductive element and being mounted on a structure, said integral element having a bend therein such that said horizontally and vertically polarized components have an angular orientation with respect to one another, said horizontally polarized component being oriented in a generally horizontal direction and said vertically polarized component being oriented in a generally vertical direction;

wherein said antenna is an open type electric field antenna, being electrically insulated from said structure, and is further capable of operating with both horizontally polarized and vertically polarized signals simultaneously.

2. The dual polarization antenna as recited in claim 1, wherein said antenna is comprised of aluminum tubing material.

3. The dual polarization antenna as recited in claim 1, wherein said horizontally and vertically polarized components are oriented as orthogonally to one another as possible.

4. A passive dual polarization antenna for an aircraft, for receiving and transmitting high frequency radio signals in the 2–30 MHz band, said aircraft having a generally horizontally oriented surface and a generally vertically oriented surface, said dual polarization antenna comprising:

a horizontally polarized component; and a vertically polarized component, said horizontally and vertically polarized components being formed of an integral conductive element having a bend therein such that said horizontally and vertically polarized components have an angular orientation with respect to one another;

said horizontally polarized component being adapted to be mounted on said generally horizontally oriented aircraft surface and said vertically polarized component being adapted to be mounted on said generally vertically oriented aircraft surface;

wherein said antenna is an open type electric field antenna, being electrically insulated from said aircraft.

5. The dual polarization antenna as recited in claim 4, wherein said antenna is comprised of aluminum tubing material.

6. The dual polarization antenna as recited in claim 4, wherein said horizontally and vertically polarized components are oriented as orthogonally to one another as the relative orientations of said generally horizontally and vertically oriented surfaces permit.

7. The dual polarization antenna as recited in claim 4, wherein said aircraft comprises a helicopter.

8. The dual polarization antenna as recited in claim 7, wherein said generally horizontally oriented surface comprises a tail boom.

9. The dual polarization antenna as recited in claim 7, wherein said generally vertically oriented surface comprises a vertical stabilizer.

10. A helicopter comprising:

a generally horizontally oriented tailboom;

a generally vertically oriented vertical stabilizer; and a passive dual polarization antenna, for receiving and transmitting high frequency radio signals in the 2–30 MHz band said antenna comprising:

a horizontally polarized component; and a vertically polarized component, said horizontally and vertically polarized components being formed of an integral conductive element, said integral element having a bend therein such that said horizontally and vertically polarized components have an angular orientation with respect to one another, said horizontally polarized component being adapted to be mounted on said tailboom and said vertically polarized component being adapted to be mounted on said vertical stabilizer;

wherein said antenna is an open type electric field antenna, being electrically insulated from said helicopter.

11. The dual polarization antenna as recited in claim 10, wherein said antenna is comprised of aluminum tubing material.

12. The dual polarization antenna as recited in claim 10, wherein said horizontally and vertically polarized components are oriented as orthogonally to one another as possible.

* * * * *